United States Patent [19]

McMillan

[11] Patent Number: 4,951,541

[45] Date of Patent: Aug. 28, 1990

[54] ADJUSTABLE REST FOR A STRINGED INSTRUMENT

[76] Inventor: Steven W. McMillan, 2615 Waugh Dr. #177, Houston, Tex. 77006

[21] Appl. No.: 255,390

[22] Filed: Oct. 11, 1988

[51] Int. Cl.[5] ..... G10D 1/02

[52] U.S. Cl. ..... 84/280

[58] Field of Search ..... 84/278, 279, 280, 281, 84/294, 296, 453

[56] References Cited

U.S. PATENT DOCUMENTS

| | | | |
|---|---|---|---|
| D. 247,642 | 3/1978 | Watson | D56/1 A |
| 1,156,925 | 10/1915 | Poehland | 84/280 |
| 1,207,678 | 12/1916 | Bolander | 84/294 |
| 1,920,850 | 8/1933 | Ebert | 84/280 |
| 2,064,925 | 12/1936 | Kolitsch | 84/280 |
| 2,248,854 | 7/1941 | Coffen et al. | 84/280 |
| 3,407,695 | 10/1968 | Perlman | 84/280 |
| 3,877,501 | 4/1975 | Toth | 84/453 X |
| 4,084,477 | 4/1978 | Dominguez | 84/280 X |

*Primary Examiner*—Brian W. Brown

*Attorney, Agent, or Firm*—Vinson & Elkins

[57] ABSTRACT

An adjustable rest for a stringed instrument such as a violin, comprises a rigid, plastic support at least partially covered with an open-cell foam backing and bearing an adjustable, multi-piece open-cell foam pad supported by wedge-shaped members which wedge-shaped members provide a selected contour particularly comfortable and pleasing to the player. Hook and loop style fasteners are used to secure the pad, wedge-shaped members, and rigid, plastic support in combination. The hook and loop material is a synthetic material which adheres when pressed together and, thus, functions as a hook and loop style fastener such as that sold under the trademark Velcro. In addition, elastic securing device, such as rubber bands, are utilized to secure the rigid, plastic support or base plate to a portion of the musical instrument. For example, the base plate is positioned in spaced relationship to the bottom plate of the violin in the area known as the lower bouts, and elastic securing device are utilized to secure the base plate in its position by looping certain of the elastic securing device about selected portions of the instrument as well as a portion of the bottom of the instrument.

20 Claims, 4 Drawing Sheets

ADJUSTABLE REST FOR A STRINGED INSTRUMENT

FIELD OF INVENTION

This invention relates to supports for stringed instruments. Specifically, the present invention relates to a shoulder rest for a violin or similar stringed instrument and comprises a rigid, support at least partially covered with a backing material and bearing an adjustable, multi-piece pad constructed of pliable material and supported by wedge-shaped members which wedge-shaped members provide a selected contour particularly comfortable and pleasing to the player.

BACKGROUND OF THE INVENTION

Stringed instruments, or chordophones, have been in existence for centuries. Their sounds are produced by striking, plucking, or rubbing strings made of vegetable fiber, metal, animal gut, or plastic, wherein the strings are displaced from a normal position of rest and caused to vibrate in a complex pattern. In nearly all stringed instruments, the sound of the vibrating string is amplified by the use of a resonating chamber or sounding board. Chordophones may be divided into four categories arranged according to the manner in which the strings are positioned in relation to the body of the instrument, particularly the resonating chamber.

The first category consists of instruments of the zither family, in which the strings lie parallel to and are of the same length as the resonating chamber. Well known examples include dulcimers in which the strings are struck, and psalteries in which the strings are plucked. A second category consists of instruments of the lyre family. A lyre is constructed from an oval, round, or rectangular sound chamber from which sound chamber two arms protrude joined at the top by a cross piece. The strings extend from the cross piece over the belly of the instrument and are connected to the belly by a bridge. The strings of the lyre are not normally stopped but are allowed to vibrate throughout their entire length when plucked by the performer. A third category consists of instruments of the harp family. Although the harp family exhibits an extraordinary variety of constructions, harps are all alike in that in all harps the strings are of unequal length and are fastened at either end to a frame that lies in the same plane as the strings. The modern orchestral harp, for example, is of triangular shape with the cross piece held nearest the player and bearing a hollow resonating chamber. The fourth category consists of instruments of the lute family, probably the most widely distributed family of stringed instruments in the world. Their characteristic structure consists of an enclosed sound chamber, or resonating chamber, with strings passing over all or part of the resonating chamber, and a neck along which the strings are stretched. The player moves his or her fingers up and down the neck, thus shortening the strings and producing various pitches. The string vibrations are transferred to the resonating chamber by a bridge; the resonator magnifies these vibrations and transfers them to the air.

The fiddle, one instrument of the lute family, can be distinguished from other members of the lute family in that it is generally played with a bow. The fiddle evolved into two groups; one group comprising relatively square shaped instruments held in the arms, known as the viola de braccia or "arm viol", and another group held between the legs, known as the viola de gamba or "leg viol." The former group may be further sub-classified depending upon the manner in which the instrument is held when it is played: either vertically or horizontally.

The violin family of stringed instruments are generally considered to be represented by a fiddle which is played in the horizontal position, specifically by holding the fiddle against the shoulder. During its history, the violin has been subject to modifications that have progressively adapted it to its evolving musical function. For example, the earlier violins were more deeply arched in the belly and back while the modern violins are shallower. Furthermore, in the nineteenth century with the advent of large auditoriums and larger concert halls and with the emergence of the violin virtuoso, the violin underwent its last major change in design. The bridge was heightened, the sound post and bass bar were thickened, and the body became flatter. In addition, the neck and the finger board were tilted backwardly placing the strings under greater tension, and, thus, giving greater pressure of the strings on the bridge. The result was a stronger, more brilliant and increased tone in place of the delicate, intimate tone of the violin of the eighteenth century. In addition to changes in the violin itself, the bow was redesigned to employ a slightly concave shape rather than the then existing convex shape; and, finally, a chin rest was added as well as shoulder rest.

Shoulder rests for use with violins and violas have been known for years, and served basically as a pillow-like member which accommodates and supports the instrument comfortably to the individual violinist's physical characteristics of shoulder and neck size. Such prior shoulder rests have had a number of deficiencies including a structure which limits the prior shoulder rest to being located in only a relatively few positions, so that the violinist usually had to compromise his or her comfort. Furthermore, some of the prior shoulder rests engaged a substantial portion of the underside of the violin thus partially absorbing and muffling the violin sound; such a structure affected the tonal quality and resonance of the instrument.

SUMMARY OF THE INVENTION

In its preferred embodiment, the adjustable rest of the present invention consists of a specially contoured base plate, at least one and preferably two supporting members preferably of wedge shape, and a body contact member such as a pad. Hook and hoop style fasteners are utilized to secure the pad to the base plate, and are utilized to secure the wedge-shaped members in selected positions between the pad and the base plate. In addition, elastic fasteners, such as rubber bands, are utilized to secure the base plate to the appropriate portion of the stringed instrument. In attaching the rest to an instrument, the rest is positioned on the instrument adjacent and in a spaced relationship across a particular portion of the instrument, for example, a portion associated with the resonating chamber. The elastic fasteners are employed to secure the rest, specifically the base plate, in its position. Then, the wedge-shaped members are affixed to the base plate by hook and loop style fasteners. Next, the pad is positioned to achieve maximum comfort when the instrument is placed in its playing position, and is secured to the base plate and to the wedge-shaped members through utilization of hook and loop style fasteners.

The base plate serves to enhance the tonal quality of the instrument, especially when the instrument is a violin or viola, by removing a portion of the instrument from contact with the players body. In addition, the base plate serves to position a microphone or other electronic, signal receiving and transmitting device, closely to the resonating chamber of the instrument so as to receive sound or vibrations from the resonating chamber and transmit the resulting signal to a computer, a digital synthesizer, or other signal manipulating device. Further, the rest serves as a supporting device for a prosthesis designed and used to position properly the instrument in a comfortable position for the player.

The primary object of this invention is to provide a musical instrument rest which is capable of being quickly applied to and removed from a stringed musical instrument without the use of screws and metal clamps or any part likely to adversely effect the tone of the instrument, which will not damage the finish of the instrument or interfere with the proper vibrations of the sounding boards or resonating chamber, and which disposes the instrument in the proper playing position and, where applicable, is comfortable to the player.

A further object of this invention is to provide a rest for stringed instruments that is simple in construction, inexpensive to manufacture and efficient in operation and service.

Another object of this invention is to provide a supporting device, which because of its size and ease of attachment, can easily be disassociated or disconnected and carried in the storage compartment of the instrument case or along side the instrument, space permitting.

Another object of the invention is to provide a shoulder rest of simple construction which is adjustably secured to a stringed instrument such as a violin or viola, and which is constructed to engage over the collar bone and to rest comfortably upon the shoulder of the player.

Another object of this invention is to provide a device which will aid the tone of the instrument and which will serve as a positioning means for a digital electronic music pickup and for selected devices associated with a Musical Instrument Digital Interface (MIDI) used, for example, with a computer or digital synthesizer.

Another object of this invention is to provide a device which can be used as a supporting device for a prosthesis designed and used to position properly the instrument in a comfortable position for the player.

Other objects and advantages of this invention will herein become more fully apparent from the following description of the drawing, which illustrates a preferred embodiment thereof.

DETAILED DESCRIPTION OF THE DRAWINGS

DETAILED DESCRIPTION OF THE PREFERRED EMBODIMENT

Figure 1:
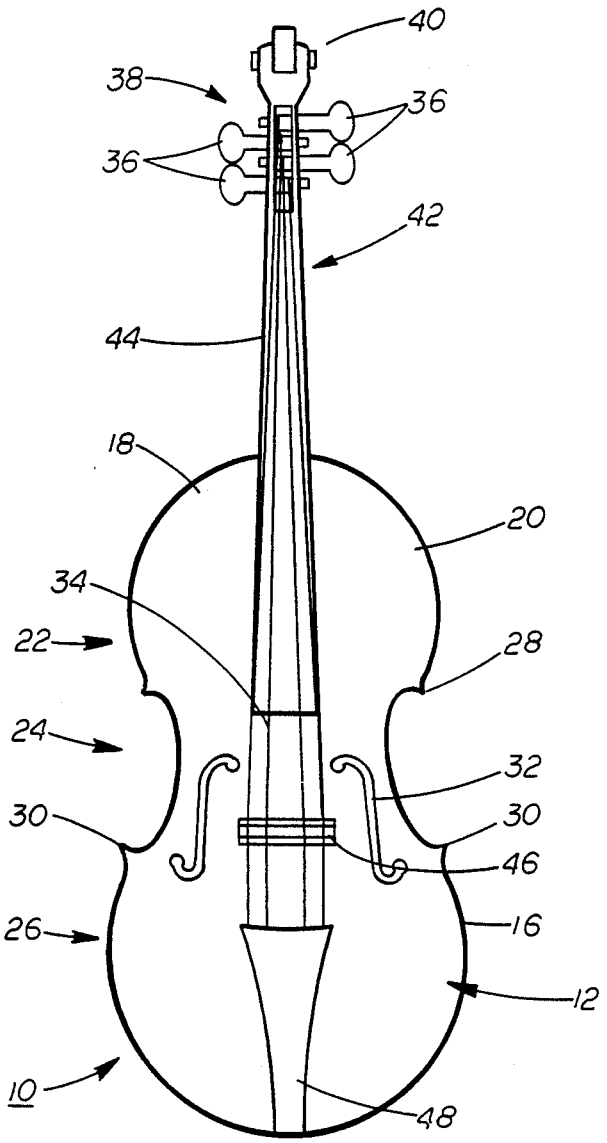
FIG. 1 is a front elevational or top view of a violin showing its major parts.
Figure 2:
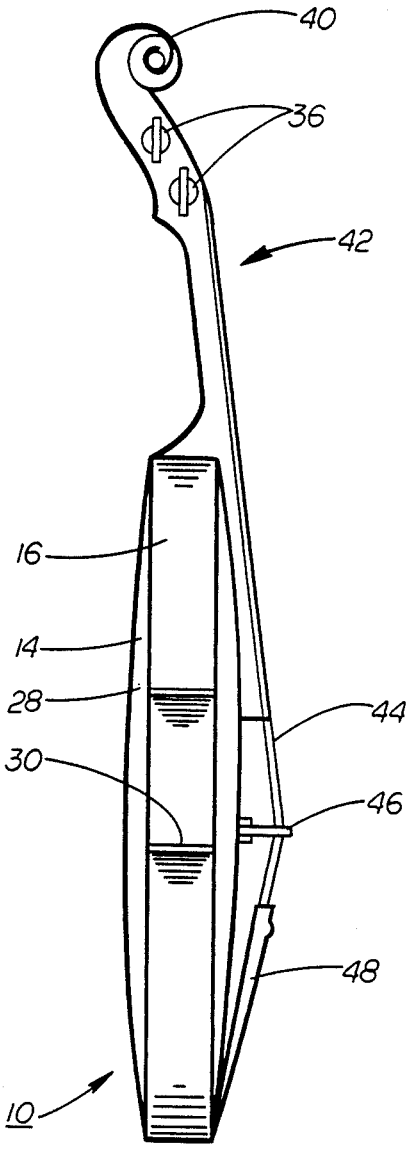
FIG. 2 is a side view of the violin of FIG. 1.
Figure 3:
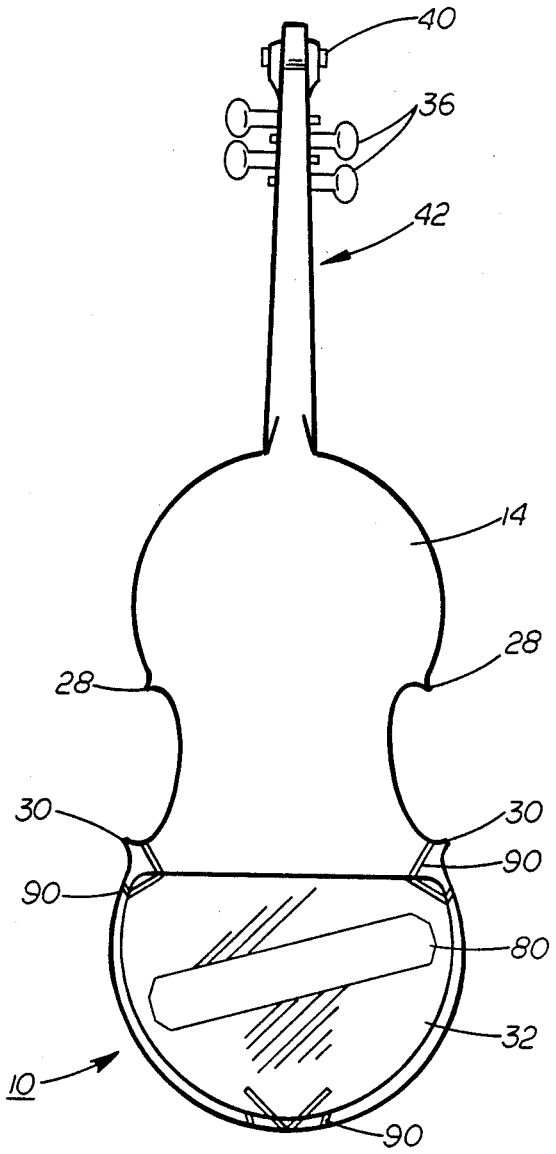
FIG. 3 is a rear elevational or back view of the violin of FIGS. 1 and 2 showing the adjustable rest of the present invention in position adjacent the lower bouts.

The preferred embodiment of the adjustable rest is a shoulder rest for a violin or viola. In order to illustrate how such a shoulder rest would be attached to such an instrument, a violin is shown in FIGS. 1, 2 and 3. A violin 10 is composed of a box 12, neck 42 and strings 34. The box or resonating chamber 12 is further comprised of a bottom plate 14, sidewall 16, top plate or sounding board 18, and purfling 20 (a reinforced projecting connection or meeting edge) located at the edges between the bottom plate 14 and the sidewalls 16, and a similar joining between the top plate 18 and the sidewalls 16. These components comprise the resonating chamber which is further divided into three sections including the upper bouts 22, the middle bouts 24, and the lower bouts 26. Each of the upper bouts and middle bouts are joined at corners 28 while each of the middle bouts and lower bouts are joined at corners 30. Associated with the middle bouts are two sound holes 32. The strings 34 are secured at one end by a peg 36 and extend from a peg box 38 located below a scroll 40 at the distal end of the neck 42, over the fingerboard 44 and bridge 46, and are attached to a string holder 48.

Figure 4:
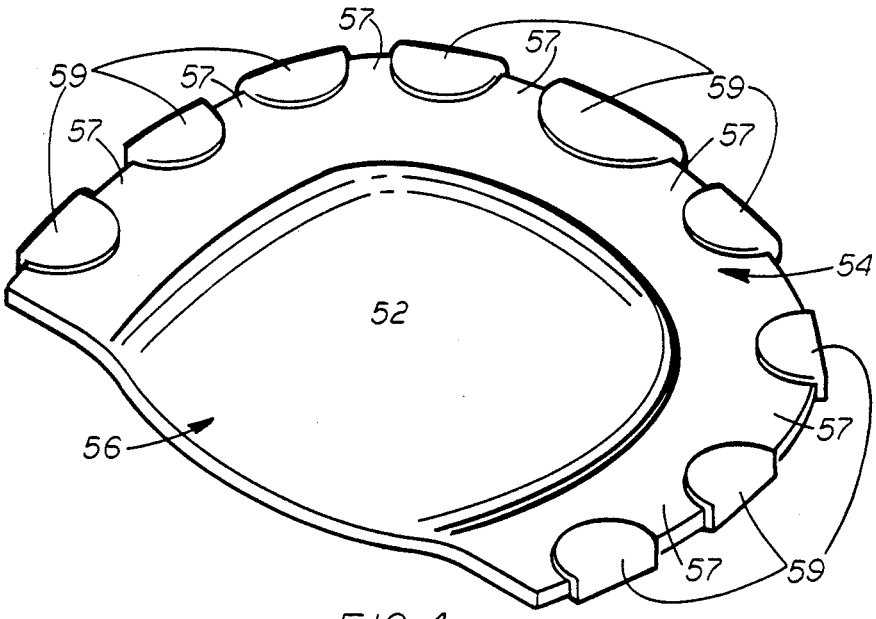
FIG. 4 is a perspective view of the preferred embodiment of the rest showing the concave interior surface of the rest as well as spacing means which contact the periphery of the sounding board.
Figure 5:
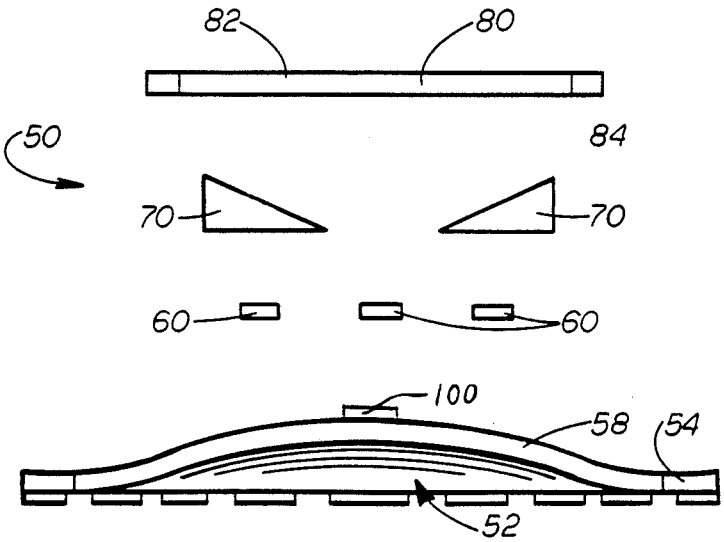
FIG. 5 is a exploded, side view of the components of the adjustable rest shown in FIG. 4.

In its preferred embodiment, the adjustable rest 50 consists of a base plate 52, securing strips 60, pliable wedge-shaped supporting members 70 and a pliable pad 80. As shown in FIG. 4, the base plate 52 consists of two major portions 54 and 56; base plate 52 is defined by an arcuate continuous peripheral sidewall constituting somewhat more than a semicircle and generally following the peripheral contour of that part of the instrument to which it is to be attached, such as the peripheral edge of the lower bouts of a violin. The first portion 54 of the base plate 52 comprises a flange-like peripheral portion which is generally planar in form. The second portion 56 of the base plate 52 is a concave portion which is contoured to accommodate a portion of the instrument to which the base plate 52 is attached, such as the bottom plate 14 of violin 10.

In its preferred embodiment, base plate 52 is a rigid structure formed either by injection molding high-impact plastic material, or by stamping or otherwise cutting blanks of high impact plastic material and then providing the necessary contour, for example, through the application of heat. A covering 58, such as polyester-cotton twill over urethane foam, is adhesively secured to the exterior surface and includes tab portions 59 which fold about selected portions of the peripheral sidewall and provide spacing means which position the rigid, base plate 52 in spaced relationship relative to bottom plate 14 of the resonating chamber 12 of violin 10. When the shoulder pad of this invention is in position, the air space between the uncovered concave interior portion of base plate 52 and the instrument allows enhanced tonal quality and provides a space in which to accommodate a microphone or other electronic signal receiving and transmitting means attached, for example, upon the concave interior portion of base plate 52. The openings 57 which occur between tab portions 59 provide additional ports or openings from which sound can escape. Further, a plurality of holes may be provided in second portion 56 of rigid base plate 52 in order to allow the rigid base plate 52 to be more acoustically transparent.

In its preferred embodiment, pad 80 is a pliable, foam material having a first side 82 and a second side 84. First side 82 may have either a smooth surface or a textured surface. The textured surface provides enhanced frictional resistance to secure the rest to the clothing of the player. Second side 84 bears a fastening device comprising either adhesively attached hook or loop material which material projects outwardly away from the pad. Assuming that the section bonded to the fabric has hook elements, a second section of loop material is releasably coupled in face to face relationship to that section of the hook material. The section of loop material, like the section of hook material, includes a backing on its reverse side which backing is a coating of an aggressively tacky, pressure sensitive adhesive which adhesive bonds the hook or loop material to the surface of the article to be secured. Securing strips 60 are hook or loop material as well, and bear an adhesive backing. In the preferred embodiment, three strips are secured to the outer or exterior portion of the rigid, base plate 52 and serve to anchor pad 80. Wedge shaped blocks 70 bear loop material on a first side and hook material on a second and opposite side, and function to secure the pad 80 to the securing strip 60, and, thus, to the exterior surface of the rigid, base plate 52.

The hook and loop material is a synthetic material which adheres when pressed together and, thus, functions as a hook and loop style fastener such as that sold under the trademark Velcro. The adhesive bond which is formed when either the hook or the loop material is positioned and attached to the appropriate structure, is quite strong relative to the bond formed between face to face coupling of the hook material and the loop material; thus, when the hook material and loop material are disengaged through a peeling action, the adhesive bond is not disturbed. This feature allows for repeated repositioning of the pad 80 relative to the rigid, back plate 52, such that a comfortable position can be determined.

Flexible securing means are utilized to secure the base plate 52 to a portion of the musical instrument. In FIG. 3, the base plate 52 is shown spanning a portion of the bottom plate 14, and secured to the lower bouts 26 preferably by elastic bands 90 which loop about corners 30 and a lower portion of the violin 20, for example, the end button of the instrument.

The adjustable rest of the present invention further comprises a sculpted rigid, base plate fabricated, for example, from plastic, wood or metal. It is contemplated that the base plate comprises a contour as deemed to be necessary to accommodate a selected portion of the stringed instrument, particularly the sounding board or resonating chamber. It is further contemplated that at least the pad may comprise a prosthesis which allows the specialized placement of the instrument relative to a player's body. In addition, it is contemplated that the spacing members, such as the wedge-shaped members, may assume different geometrical shapes as desired positioning of the instrument dictates. Also, the pad and spacing members may comprise a monolithic structure, or may assume a unitary structure as when they are joined one to the other. The foam material utilized in each structural element of the adjustable rest of the present invention can be either an open-cell foam or a closed-cell foam, and the fabric used to cover the rigid base plate may be selected from, for example, leather, chamois, cloth, or elastomeric material, which choices provide a customized rest. It is contemplated that the adjustable rest of the present invention can accommodate several devices including a microphone or other electronic sound pick-up means placed either upon an interior or upon an exterior portion of the rigid base plate, and including, for example, a "wha-wha" style sound manipulation device attached to the rigid base plate, for example, as one of the wedge-shaped structural members and positioned so as to be manipulated by the chin and shoulder of the player. Further, it is contemplated that other electronic signal receiving and transmitting means may be attached to the adjustable rest, for example, by hook and loop style fasteners or by adhesive joining means such as tape or glue.

I claim:

1. An adjustable rest for a stringed instrument, comprising, in combination:

a rigid base plate bearing at least one securing strip adhesively bonded to a first major side portion of said rigid base plate, said at least one securing strip bearing a first group of outwardly extending hook or loop style fasteners;

at least one intermediate supporting member bearing on its first side a second group of outwardly extending hook or loop style fasteners which second group of fasteners complements and releasably adheres to said first group of fasteners, and bearing on its second and opposite side a third group of outwardly extending hook or loop style fasteners identical in function to said first group of outwardly extending hook or loop style fasteners; and a body contact member bearing on its first side a fourth group of outwardly extending hook or loop style fasteners which fourth group complements and releasably adheres to said third group of hook or loop style fasteners, and which fourth group is identical in function to said second group of outwardly extending hook and loop style fasteners;

wherein said at least one intermediate supporting member is releasably joined to said at least one securing strip borne by said rigid base plate, through face to face coupling of said first group of fasteners with said second group of fasteners, and said body contact member is releasably joined to said at least one intermediate supporting member through face to face coupling of said third group of fasteners with said fourth group of fasteners.

2. The adjustable rest of claim 1 wherein said rigid base plate is defined by a solid, substantially horseshoe-shaped configuration particularly described by an arcuate continuous peripheral sidewall constituting somewhat more than a semicircle, and having a flange-like peripheral portion adapted to engage a portion of said instrument, said flange-like portion being generally planar in form and bordering a first major side surface defining a concave interior portion contoured to accommodate a portion of said instrument.

3. The adjustable rest of claim 2 wherein said rigid base plate is fabricated from a high-impact plastic material.

4. The adjustable rest of claim 2 wherein said rigid base plate is selectively covered with pliable material on a second major side surface positioned oppositely from said first major side surface.

5. The adjustable rest of claim 4 wherein said pliable material consists of a combination of polyester-cotton twill over urethane foam which combination is adhesively bonded to said rigid base plate.

6. The adjustable rest of claim 5 wherein said material includes lobe-like pieces which are folded about said arcuate contoured peripheral sidewall and are secured to said flange-like portion to provide a plurality of spacers which function to position said rigid base plate in spaced relation to said instrument when said rigid base plate is positioned upon said instrument.

7. The adjustable rest of claim 2 further comprising an electronic signal receiving and transmitting means positioned upon a portion of said adjustable rest.

8. The adjustable rest of claim 2 wherein said body contact member is a prosthetic device.

9. The adjustable rest of claim 2 further comprising flexible securing connections fixed to said rigid base plate at selected locations and adapted to hold said adjustable rest in position upon said instrument.

10. The adjustable rest of claim 9 wherein said flexible securing connections are elastic bands.

11. The adjustable rest of claim 2 wherein said at least one intermediate supporting member is of wedge shape.

12. The adjustable rest of claim 2 wherein said rigid base plate includes a plurality of apertures which allow increased acoustical transparency of said rigid base plate.

13. An adjustable shoulder rest for a violin and other stringed instruments, comprising:

a rigid base plate having a solid, substantially horseshoe-shaped configuration partially defined by an arcuate continuous peripheral sidewall constituting somewhat more than a semi-circle, and having a flange-like peripheral portion adapted to engage said instrument and being substantially planar in form and bordering an interior portion contoured to accommodate a particular portion of said instrument, said rigid contoured base plate having an exterior portion selectively covered by a pliable material, said pliable material including lobe-like pieces which are folded about selected portions of said arcuate continuous peripheral sidewall and are adhesively secured to said flange-like portion to provide a plurality of spacers which function to position said rigid base plate in spaced relation to said particular portion of said instrument, and said rigid base plate bearing at least one securing strip comprising a backing layer adhesively secured to an exterior portion of said rigid base plate, and a first mating means including a first group of protruding members extending outwardly from said backing layer;

at least one pliable supporting member of wedge-shaped configuration, each of said supporting members having a first side and a second side, said first side bearing a second mating means adhesively secured thereto, said second mating means including a second group of protruding members extending outwardly from said first side, said first mating means and said second mating means being mutually releasably couplable whereby each of said supporting members can be releasably detached from said rigid base plate, and said second side bearing a third mating means adhesively secured thereto, said third mating means including a third group of protruding members extending outwardly from said second side;

body contact member bearing a fourth mating means adhesively secured thereto, said fourth mating means including a fourth group of protruding members extending outwardly from said body contact member, said fourth mating means and said third mating means being mutually releasably couplable whereby said body contact member can be releasably detached from each of said supporting members; and flexible securing connections fixed to said rigid base plate at selected locations and adapted to hold said adjustable rest in position upon said instrument.

14. The adjustable rest of claim 13 wherein said first group of protruding members and said third group of protruding members are each a plurality of loop members, and said second group of protruding members and said fourth group of protruding members are each a plurality of hook members.

15. The adjustable rest of claim 13 wherein said first group of protruding members and said third group of protruding members are each a plurality of hook members, and said second group of protruding members and said fourth group of protruding members are each a plurality of loop members.

16. The adjustable rest of claim 13 wherein said body contact member is a prosthetic device.

17. The adjustable rest of claim 13 further comprising an electronic signal receiving and transmitting means positioned upon a portion of said adjustable rest.

18. The adjustable rest of claim 13 wherein said flexible securing connections are elastic bands.

19. The adjustable rest of claim 13 wherein said rigid base plate includes a plurality of apertures which allow increased acoustical transparency of said rigid base plate.

20. The adjustable rest of claim 13 wherein a first wedge-shaped supporting member includes a first angle of inclination and a second wedge-shaped supporting member includes a second angle of inclination, said first angle of inclination differing from said second angle of inclination.

* * * * *